US006589024B2

(12) United States Patent
Nishikawa et al.

(10) Patent No.: US 6,589,024 B2
(45) Date of Patent: Jul. 8, 2003

(54) RECIPROCATING COMPRESSOR

(75) Inventors: Takahiro Nishikawa, Osaka-fu (JP); Hiroshi Nishikawa, Osaka-fu (JP); Takashi Harako, Osaka-fu (JP); Takayuki Mizuno, Osaka-fu (JP); Kazuya Sato, Osaka-fu (JP); Yasuo Sakamoto, Osaka-fu (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 09/917,248

(22) Filed: Jul. 27, 2001

(65) Prior Publication Data

US 2002/0012592 A1 Jan. 31, 2002

(30) Foreign Application Priority Data

Jul. 28, 2000 (JP) ..... 2000-228937
Jul. 28, 2000 (JP) ..... 2000-228940
Jul. 28, 2000 (JP) ..... 2000-228948
Jul. 28, 2000 (JP) ..... 2000-228953

(51) Int. Cl.[7] ..... F04B 1/04; F04B 25/00
(52) U.S. Cl. ..... 417/273; 417/254
(58) Field of Search ..... 417/273, 244, 417/254

(56) References Cited

U.S. PATENT DOCUMENTS 1,677,539 A * 7/1928 Wollman ..... 417/273
2,337,582 A * 12/1943 Wineman ..... 417/270
2,364,111 A * 12/1944 Tucker ..... 417/273
2,668,004 A * 2/1954 Browne ..... 417/265
2,725,182 A * 11/1955 Spriggs ..... 417/273
4,421,073 A * 12/1983 Arregui et al. ..... 123/43 R
4,645,428 A * 2/1987 Arregui et al. ..... 417/273
5,584,675 A * 12/1996 Steurer et al. ..... 417/372
5,846,059 A * 12/1998 Mizuno et al. ..... 417/273

* cited by examiner

*Primary Examiner*—Charles G. Freay
*Assistant Examiner*—Timothy P. Solak
(74) *Attorney, Agent, or Firm*—Weingarten, Schurgin, Gagnebin & Lebovici LLP

(57) ABSTRACT

A reciprocating compressor provided with a plurality of gas compression means having a cylinder and a piston, the piston of each gas compression means is cooperated with the, compressor by converting a rotating motion of a crankshaft provided on an electric drive source to a reciprocating motion by a scotch yoke mechanism, wherein an increase of the volume of discharged gas can be achieved without designing a gas compression means to be wide or without increasing the number thereof, a pulsation of discharged gas can be decreased by an attachment of an expression muffler on the cylinder head so as to decrease a vibration and noise of the compressor, an attachment of the fly wheel to the crankshaft and an adjustment of the shaft with the crankshaft can be improved easily, further compressed gas flows are joined and discharged in concentration, thereby the pulsation of discharged gas can be restrained.

4 Claims, 7 Drawing Sheets

-PRIOR ART-

-PRIOR ART-

-PRIOR ART-

-PRIOR ART-

RECIPROCATING COMPRESSOR

BACKGROUND OF THE INVENTION

1. Field of the Invention

The present invention relates to a reciprocating compressor in which a plurality of gas compression means having a cylinder and a piston is provided, the pistons of each gas compression means are formed to cooperate by converting a rotating motion of a crankshaft provided on a driving source to a reciprocating motion.

2. Detailed Description of the Prior Art

In a normal reciprocating compressor, one gas compression means having a cylinder and a piston is provided, while there has been a reciprocating compressor having a plurality of gas compression means conventionally. In such reciprocating compressor having a plurality of gas compression means, for embodiment as shown by FIG. 9(*a*), three gas compression means 101, 102, 103 having the cylinders and the pistons are oppositely arranged to achieve a reciprocating motion of the piston on orthogonal axis 105, 106, it is known that gas is compressed and high-pressurized from the gas compression means 101 in turns and that the gas compression means 103 is designed to be a final stage high pressure compression means.

In the reciprocating compressor 100, a pair of opposite pistons 51, 53 is connected to a yoke 1A, the other pair of opposite pistons 52, 54 is connected to a yoke 1B of which phase is shifted to an angle of 90 degrees. The compressor having a scotch yoke mechanism that a crankshaft 57 is rotated by a rotor 56 of an electric drive mechanism 55 as shown by FIG. 9(*b*), a crank pin 58 is eccentrically rotated around the crankshaft 57, a pair of pistons 51, 53 is reciprocated only in the direction of an axis 105 and the other pair of pistons 52, 54 is reciprocated in only the direction of the axis 106.

As shown by FIG. 11 as a model, the scotch yoke mechanism is a kind of double slide crank mechanism to convert the rotating motion to the reciprocating motion or to do the reciprocating motion to the rotating motion. In this case the rotating motion is converted to the reciprocating motion, in the scotch yoke mechanism having the yokes 1A, 1B, a crank pin 58 is attached between a lower balancer 59 and an upper balancer 60 which are mounted on a crankshaft 57 as shown by FIG. 10 and is engaged with yokes 1A, 1B, thereby the vibration or the like of the compressor is controlled and the compression can be operated in stable.

In the reciprocating compressor 100 described hereinbefore, it is described herein that in accordance with an increase of compression stages, diameters of the cylinder and the piston of the gas compression means toward the high pressure side are designed to be smaller and each compression means is engaged and, cooperated with the crank pin so as to actuate in a process of shifting its phase to a determined angle.

SUMMARY OF THE INVENTION

In the conventional reciprocating compressors, the compressed gas are highly pressurized one after another to achieve a predetermined gas pressure, however due to less inner volume of each gas compression means toward the high pressure side, the volume of the final discharged compression gas is decreased. In accordance with an object, for embodiment, for using the compressor for a gas supply stand for natural gas vehicles, a gas injection molding machine, an electric insulating gas (6-sulfur fluoride) collecting device, carbon dioxide coolant and refrigerating cycle and the like, especially it is requested to supply a large volume of compressed gas. To correspond with these requirement, the inner volume thereof can be increased by providing a large diameter of the cylinder and the piston of the compression means, however it will cause a large sizing of the compressor, an increase of electric consumption of the electric drive portion and a high cast. Further to use a plurality of compressors will cause an increase of space where compressors are located and an increase of the cost and the like.

It is the first object of the present invention that in a reciprocating compressor having a plurality of gas compression means, the volume of discharged gas can be increased without using a plurality of compressors.

Further in the conventional reciprocating compressor, the pulsation is caused by a discharged gas around the discharge port of each gas compression means 101, 102, 103 to make a vibration or a noise of the compressor. Therefore in conventional compressor, a muffler tube (not shown) is attached to the connecting tube with each gas compression means 101, 102, 103 to decrease the pulsation of discharged gas. However it is necessary to cut and remove a part of the connecting tube for mounting the muffler tube and to weld the muffler tube thereto, the troublesome working is caused, further the main body of the compressor is large-sized due to a larger diameter of the muffler tube than the outer diameter of the connecting tube and it has caused an increase of the cost due to an increase of manufacturing processes and of parts. The conventional muffler tube is inferior in its durability and has a problem of easily damaged by a high pressurized discharging gas.

It is the second object of the present invention to provide a reciprocating compressor to which the muffler is easily attached, which is designed in compact, in which a decrease of the cost of manufacturing and an improvement of its durability can be achieved.

Further in the conventional reciprocating compressors, in order to achieve a constant rotating speed of the crankshaft and to provide an stationary torque thereof, a flywheel is mounted on the lower end portion of the crankshaft. For attaching the flywheel, conventionally, for embodiment as shown in FIG. 6, a shaft hole 61*a* of the fly wheel 61 is shrinkage fit to the lower end portion of the crankshaft 57 which is projected from the shaft hole of the rotor 56. While an external thread is provided at the lower end portion of the crankshaft 57 and the internal thread is provided at the shaft hole of the flywheel 61 to be engaged with each other for receiving the flywheel. In accordance with conventional means for attaching flywheel, the attachment work is troublesome, further it is difficult to adjust respective axis of the crankshaft 57 and of the flywheel 61, and a slight movement will be caused since an axial line of the flywheel 61 is incliningly attached.

It is the third object of the present invention to provide the reciprocating compressor improved in easy attachment work of the flywheel and in an easy adjustment with the crankshaft to prevent the shaft from shifting.

Furthermore in the conventional reciprocating compressor, in order to increase the volume of discharged gas, gas compressed in a plurality of gas compression means are joined at the one place by connecting tube and are discharged in concentration. In this case, the compression performance of each gas compression means is set to be identical by designing the cylinder and the piston to be same size, the compression action of each gas compression means is shifted with a certain intervals in accordance with a rotation of the crank pin, for embodiment, the compressor is so comprised that compressed gas flow is joined by connecting tubes to cylinder head which is provided in one gas compression means and the compressed gas is discharged in concentration from the cylinder head. However in such concentrate discharging type compressor, since compressed gas flows are joined via a plurality of connecting tubes into the cylinder head to interfere with each other, a large pulsation is caused. Therefore, the muffler is provided in each connecting tube to decrease the pulsation of discharged gas from each gas compression means, however it is troublesome to attach the muffler, moreover the increase of the cost due to large number of parts has been caused and there has been a problem of large sized main body of the compressor and the like.

It is the fourth object of the present invention to provide the reciprocating compressor of the type improved in decreasing the pulsation due to interference of the compressed gas flows which are joined without attaching the muffler in the connecting tube.

DETAILED DESCRIPTION OF THE PREFERRED EMBODIMENT

The embodiment of the reciprocating compressor in accordance with the present invention will be described with reference to accompanied drawings.

Embodiment 1

Figure 1:
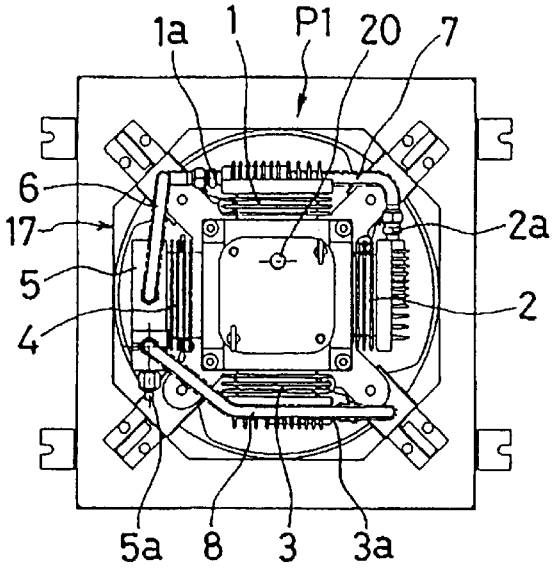
FIG. 1*a* illustrates a plane view of an embodiment of a reciprocating compressor according to the present invention.
FIG. 1*b* is a partially cut-away front view of an embodiment of a reciprocating compressor according to the present invention.
FIG. 1*c* is a partially cut-away side view of an embodiment of a reciprocating compressor according to the present invention
Figure 1:
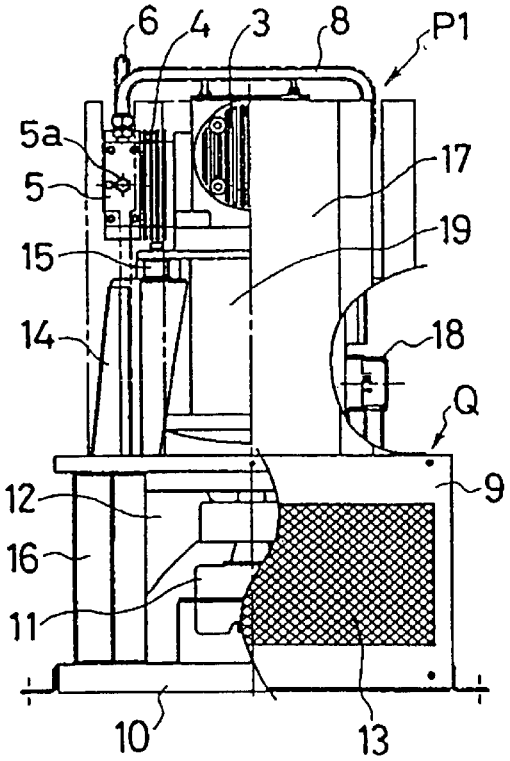
Figure 1:
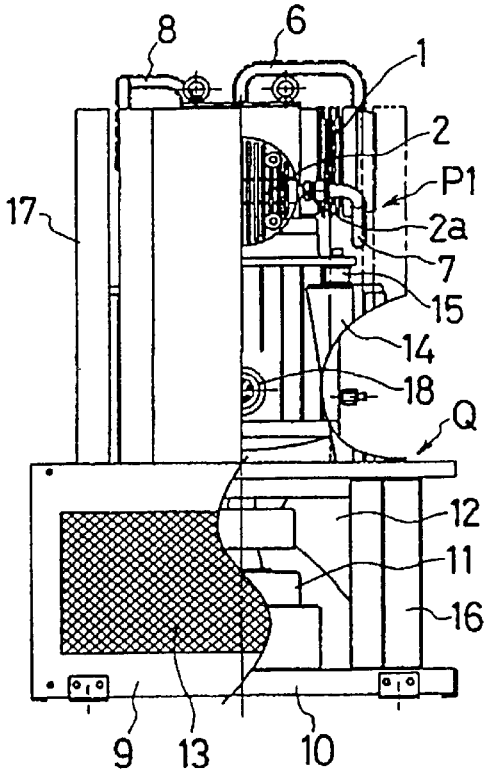

It is an embodiment to achieve the first object of the present invention in, FIG. 1(*a*) illustrates a general of the reciprocating compressor by respective plane view, (*b*) is partially cut-away front view and (*c*) is partially cut-away side view. In a reciprocating compressor P1, four gas compressors that is, the first gas compression means 1, the second one 2, the third one 3 and the fourth one 4 are oppositely disposed one another in a cross shape. These four gas compression means 1 to 4 respectively include cylinders and pistons. These are different from the conventional reciprocating compressor described hereinbefore and these have one another the same inner volume and the same compressing performance. The piston of the first gas compression means 1 and the piston of the third gas compression means 3 are connected on the same axis with each other to one of yokes and the piston of the second gas compression means 2 and the piston of the fourth gas compression means 4 are connected on the same axis with each other to the other yoke of which phase is shifted to an angle of 90 degrees.

A cylinder head 5 is attached on a head portion of the cylinder in the fourth gas compression means 4, a gas passage is provided in an interior thereof and a discharge port 5*a* is provided at the one end thereof. The discharge port la of the first gas compression means 1, the discharge port 2*a* of the second gas compression means 2 and the discharge port 3*a* of the third gas compression means 3 are respectively connected to the gas passage by a first connecting tube 6, a second connecting tube 7 and a third connecting tube 8. Thereby the flow of gas compressed by each gas compression means 1 to 4 is joined to the gas passage of the cylinder head 5.

The reciprocating compressor P1 is un-lubricating type and includes a cooling device Q for cooling, as shown by FIG. 1(*b*)(*c*), in which a fan motor 11 is mounted on a unit base 10 in a fan casing 9, a cooling fan 12 is attached on an end of the rotating shaft of the motor and an air inlet 13 provided with a net is mounted on a side surface portion of the fan casing 9. The reciprocating compressor P1 is attached on the cooling device Q via a leg member 14 of which upper end is intervened with a rubber vibration isolator 15 so as to absorb the vibration of the compressor P1. Further on four corners in the casing 9, supports 16 are stood for supporting the reciprocating compressor P1 in stable. Numeral 17 illustrates a casing for cooling arranged on the periphery of the reciprocating compressor P1. 18 is a terminal cover for protecting a connecting terminal of an electric motor part 19 of the compressor P1.

In the reciprocating compressor P1 designed as described hereinbefore, gas is supplied from a gas supply source (not shown) to an inlet port 20 which is mounted on an upper portion thereof and thereafter flows into cylinders of the first to the fourth gas compressing means 1 to 4 so as to be compressed by pistons. The compression process by the piston is achieved that a crank pin is rotated via the crank shaft in accordance with a rotation of a rotor of the electric motor part 19 to actuate two yokes of which phase is shifted to an angle of 90 degrees. For one rotation of the crank pin, the same as conventional ones, the first gas compression means 1 to the fourth gas compression means 4 are compressed in turns so that gas compressed by the first gas compression means 1 is discharged from the discharge port la and is fed into the cylinder head 5 via the first connecting tube 6, in the same way as that, gas compressed in the second and the third gas compression means are fed into the cylinder head 5 respectively via the second and the third connecting tubes 8. Further gas compressed by the fourth gas compression means 4 is fed from the discharge port 4*a* into the cylinder head 5. Therefore gas flows respectively compressed in the first gas compression means 1 to the fourth gas compression means 4 are joined in the gas passage in the cylinder head 5 and are discharged in concentration from the discharge port 5*a* of the cylinder head 5. Thereby a volume of compressed gas from the reciprocating compressor P1 is increased to four times.

As described hereinbefore, the piston of the first gas compression means 1 and the opposite piston of the third gas compression means 3 are directly connected to one of yokes so that the gas suction via the third gas compression means 3 into the cylinder is achieved simultaneously with gas compression action by the first gas compression means 1, to the contrary, gas compression action in the third gas compression means 3 is achieved simultaneously with gas suction via the first gas compression means 1 into the cylinder. In the same way, the piston of the second gas compression means 2 and the opposite piston of the fourth gas compression means 4 are directly connected to the other yoke of which phase is shifted to an angle of 90□degrees so that the gas suction via the fourth gas compression means 4 into the cylinder is achieved simultaneously with gas compression action by the second gas compression means 2, to the contrary, gas compression action by the fourth gas compression means 4 is achieved simultaneously with gas suction via the second gas compression means 2 into the cylinder. Thereby in accordance with a rotation of the crank pin the compression action is repeated by the first gas compression means to the fourth gas compression means in turn, and a volume of compressed gas of which the flow is joined in the cylinder head 5 can be discharged continuously.

Figure 2:
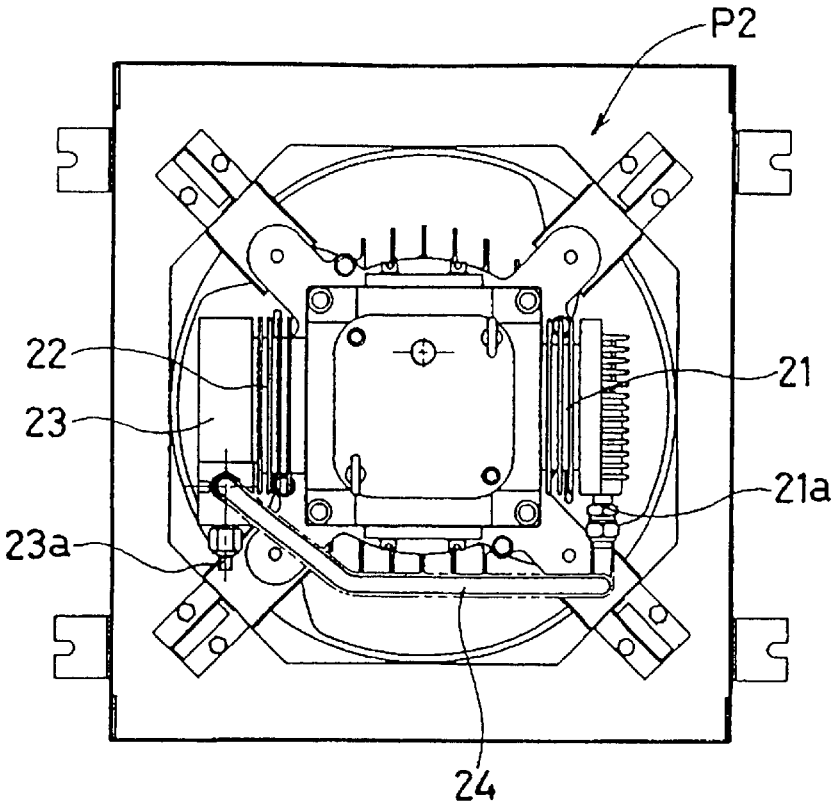
FIG. 2 is a plane view of an embodiment of the reciprocating compressor according to the present invention is applied for an one stage compressor with two cylinders.

An embodiment of a single stage compression with four cylinders is described hereinbefore and as shown by FIG. 2, it can be achieved by a reciprocating compressor P2 comprising a single stage compression with two cylinders so that the first gas compression means 21 and the second gas compression means 22 are oppositely disposed to have a composition that a discharge port 21*a* of the first gas compression means 21 and a cylinder head 23 at the side of the second gas compression means 22 are connected each other by a connecting tube 24. In the reciprocating compressor P2, the flow of gas compressed in the first gas compression means 21 is fed into the cylinder head 23 via the connecting tube 24 and joined with gas compressed by the second gas compression means 22 and is discharged in concentration from a discharge port 23*a* of the cylinder head 23. Thereby the volume of discharged gas can be increased two times.

In this case, a piston of the first gas compression means 21 and the piston of the second gas compression means 22 are connected to one yoke and reciprocated by the scotch yoke mechanism so that the gas compression is achieved at one side and the gas suction is achieved at the other side. Moreover it is not shown by drawings, a gas compression can be achieved by three cylinders or by five cylinders respectively arranged in facing with each other such as a star shape and the like other than a cross shape.

Figure 3:
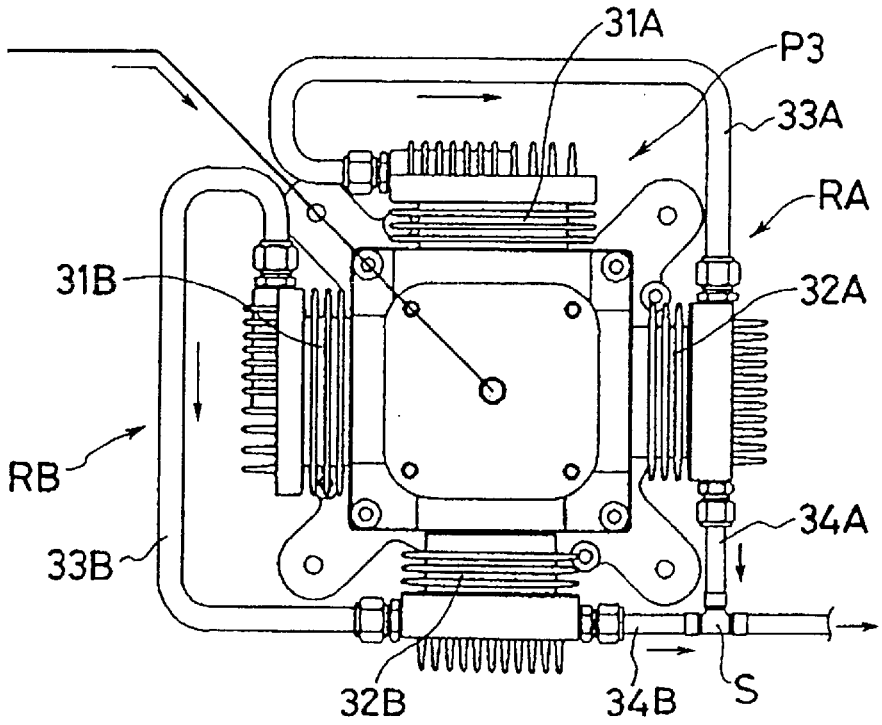
FIG. 3 is a plane view of an embodiment of the reciprocating compressor according to the present invention is applied for a two staged compressor mechanism with two systems.

An embodiment of the compressor applied for two stage compression system is shown in FIG. 3, a reciprocating compressor P3 comprises two stage compression mechanism with two systems in which four gas compression means are arranged in facing with each other in a cross shape. The first stage gas compression means 31A, 31B are arranged in shifting its phase to an angle of 90 degrees, the second gas compression means 32A, 32B are also arranged in shifting its phase to an angle of 90 degrees and the first stage gas compression means 31A and the second stage gas compression stage 32A are connected with each other by a connecting tube 33B, thereby two stage compression mechanism RA, RB having two systems are formed so that discharge tubes 34A, 34B of second stage gas compression means 32A, 32B are joined at a point S to discharge gas in concentration.

The first stage gas compression means 31A in the two stage compression mechanism RA and the second stage gas compression means 32B in two stage compression mechanism RB are directly connected in an opposite position to one of yokes and the first stage gas compression means 31*b* of the two stage compression mechanism RB and the second stage gas compression means 32A in the two stage compression mechanism RA are connected at an opposite position to the other yoke of which phase is shifted to an angle of 90 degrees. In this case, according to one rotation of the crank pin, gases are compressed by the first stage gas compression means 31B, 31A to the second stage gas compression means 32A, 32B in turn. Gases compressed by the first stage gas compression means 31B, 31A are fed into the second stage gas compression means 32B, 32A via the connecting tube 33B, 33A and are joined at the point S to discharge in concentration by discharge tube 34B, 34A. Thereby high pressurized gases respectively compressed by two stage compression mechanism RA, RB having two systems are joined and the volume of discharged gas can be increased two times.

In accordance with the present invention, in the reciprocating compressor having a plurality of gas compression means, the flows of gas compressed by each gas compression means are joined into an one place and are discharged in concentration, thereby it is not necessary to design the main body of the compressor in a large size or to use a plurality of compressors for increasing the volume of gas discharged in several times in accordance with numbers of gas compression means. Further two stage compression mechanism having two systems can be achieved and the volume of gas discharged can be increased by joining a high pressurized gas which is compressed in each two stage compression mechanism at one place and discharging it.

Embodiment 2

Figure 4:
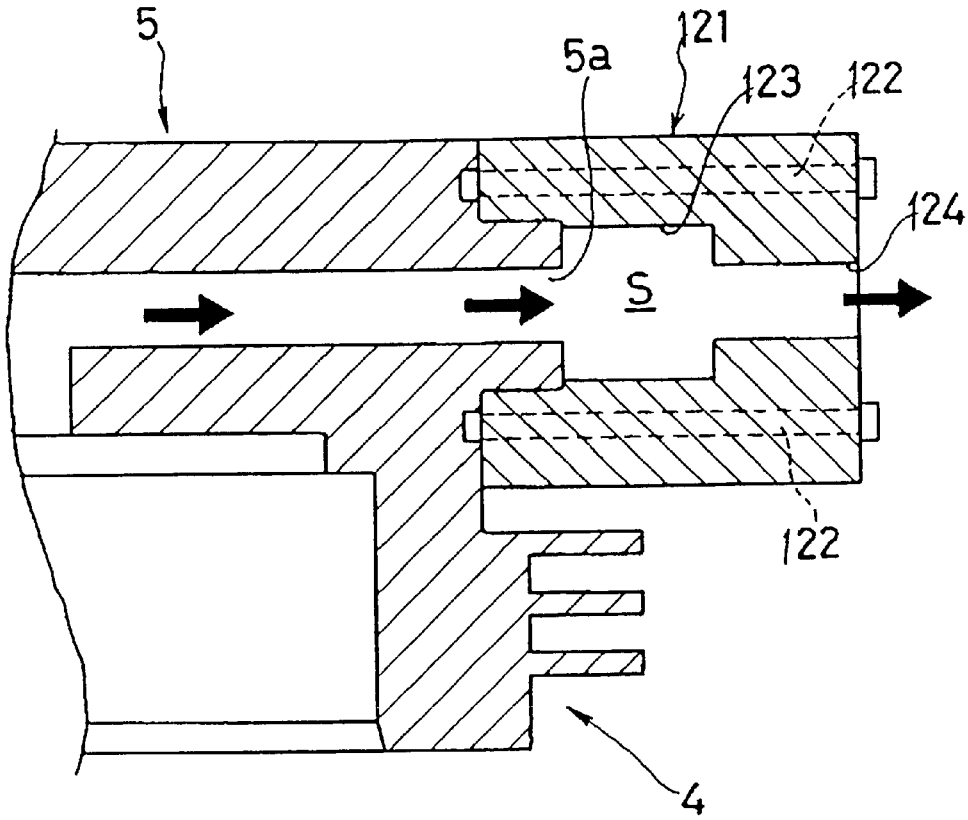
FIG. 4 is a schematic cut-away view of an embodiment of an expansion muffler is attached to a cylinder head of a gas compression means.

The second object of the present invention can be achieved by this embodiment, in FIG. 4, numeral 121 illustrates a discharge block which is mounted on a discharge port 5*a* of the cylinder head 5 in the fourth gas compression means 4 by a fastening bolt 122. An expansion muffler 123 is formed at the joining portion for the discharge port 5*a* of the discharge block 121. The expansion muffler 123 is formed by providing a space portion S having a larger inner diameter than that of the discharge port 5*a* of the cylinder head 5 and a discharge opening 124 having a smaller inner diameter than that of the space portion S is formed at the end of the muffler 123. A gas supply tube (not shown) is connected to the discharge opening 124.

As described hereinbefore, gases compressed by the first gas compression means 1 to the third gas compression means 3 are respectively fed into the cylinder head 5 at the side of the fourth gas compression means 4 through the first connecting tube 1 to the third connecting tube 3 to join with gas compressed by the fourth gas compression means 4 and are discharged to the discharge block 121 from the discharge opening 5*a* of the cylinder head 5. Due to the expansion muffler 123 formed on the discharge block 121, high pressurized gas from the discharge opening of the cylinder head 5 is rapidly decreased its pressure at the time of passing through the means S. Therefore the pulsation can be decreased and the vibration or the noise can be restrained in accordance therewith.

The discharge block 121 does not need much means for attachment on the discharge port 5*a* of the cylinder head 5 so as to prevent the main body of the reciprocating compressor from being large size. Since the discharge block 121 is easily attached by the fastening bolt 122 and an easy attachment work of the conventional muffler tube can be achieved and the number of processes, parts thereof and a cost of manufacturing can be restrained. Furthermore the discharge block 121 has more excellent durability than the conventional muffler tube and can correspond with a high pressurized discharge gas.

In the embodiment described above, the discharge block 121 contained with the expansion muffler 123 is attached to the cylinder head 5 only in the fourth gas compression means 4 and can be also attached respectively on the discharge opening of the first gas compression means 1 to the third gas compression means 3. Thereby the pulsation of the discharged gas can be decreased more.

In accordance with the present invention, in the reciprocating compressor including a plurality of gas compression means, the expansion muffler is attached on at least one discharge port of the gas compression means so that the pulsation of the discharged gas can be decreased to restrain the vibration and the noise and an easy assembling work, a compact design, a reduction of a cost for manufacturing compressor and an improvement of the durability can be achieved.

Embodiment 3

Figure 5:
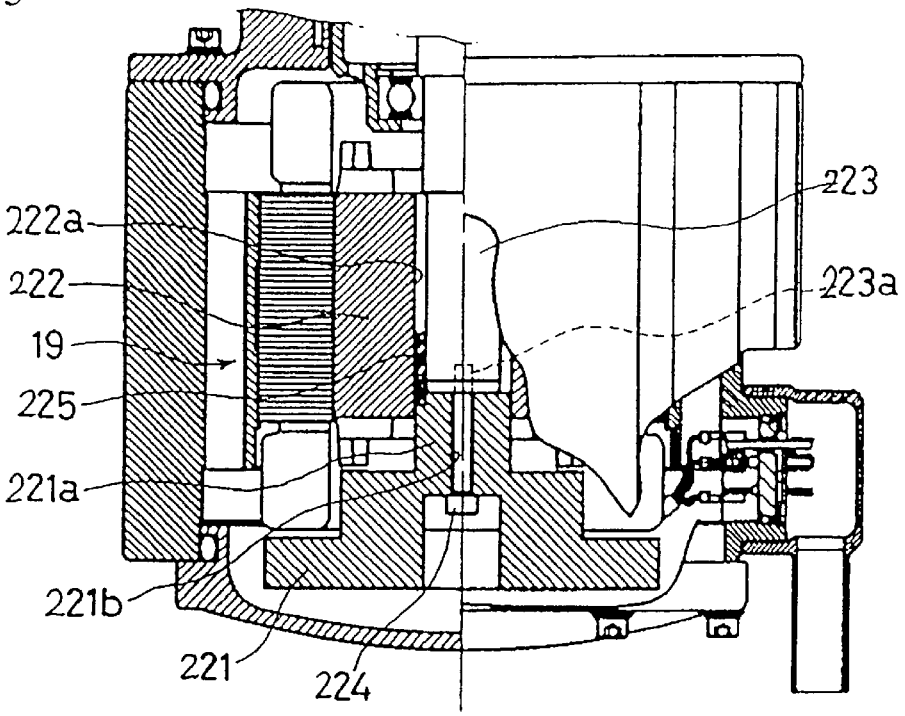
FIG. 5 is a schematic cut-away view of a main portion illustrating for attaching a fly wheel to a crankshaft.
Figure 6:
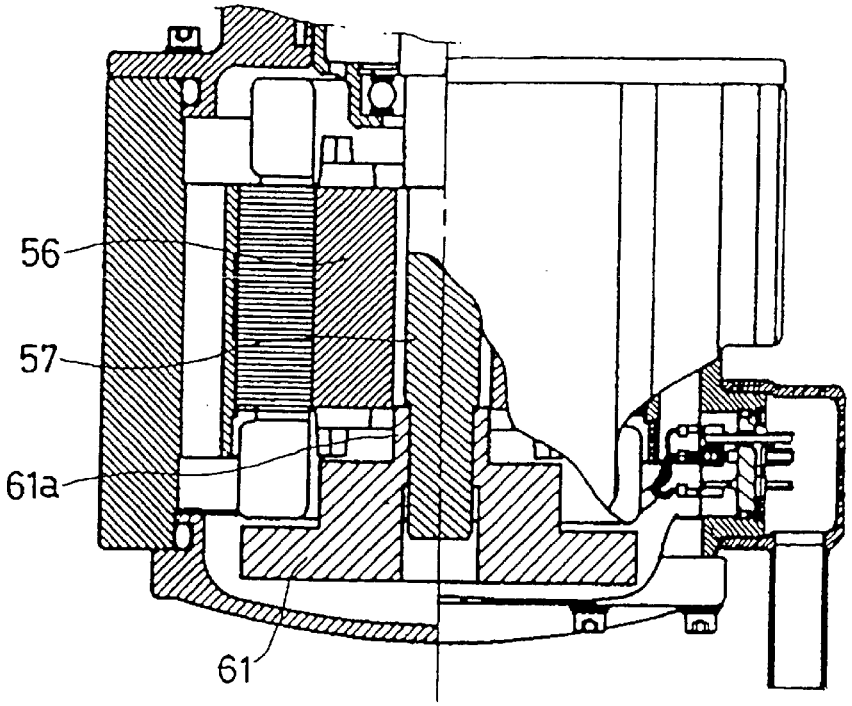
FIG. 6 is a schematic cut-away view of a main portion illustrating for attaching a conventional fly wheel to a crankshaft.

The embodiment refers to achieve the third object of the present invention, in FIG. 5, numeral 221 illustrates a flywheel of which upper end portion is provided with a cylindrical attachment portion 221*a* and of which axial direction is provided with an attachment hole 221*b*. The cylindrical attachment portion 221*a* is formed on a base of a shaft hole 222*a* of a rotor 222 in the electric motor part 19, that is, an outer diameter of the attachment portion 221*a* is designed to correspond with an inner diameter of the shaft hole 222*a* of the rotor 222. For attaching the flywheel 221, the cylindrical attachment 221*a* is inserted into the shaft hole 222*a* of the rotor 222 so as to contact its upper end surface with the lower end surface of the crankshaft 223 and a fastening bolt 224 is inserted into the attachment hole 221*b* to be threaded and fastened in a screw hole 223*a* which is provided in an axial direction of the crankshaft 223.

At the time of attaching the flywheel on the crankshaft, an axial line of the flywheel 221 and one of the crankshaft 223 is accorded with each other and with an axial line of the rotor 222 too when the cylindrical attachment portion 221*a* of the flywheel 221 is inserted into the shaft hole 222*a* of the rotor and the upper end surface thereof is contacted with the lower end surface of the crankshaft 223. Since the crankshaft 223 is so attached to the rotor 222 that the axial line of the crankshaft 223 is previously accorded therewith, the axial line of the flywheel 221 is accorded with the crankshaft 223 via the rotor 222. Thereby an adjustment of axial lines of the flywheel 221 and the crankshaft 223 can be achieved more easily than the conventional ones and since the flywheel can be fixed by not a shrinkage fit but one bolt so as to achieve a easy working. It is enough to provide the screw hole 223*a* at the side of the crankshaft 223 and less of the thread work can be achieved than a conventional screw type. In this case the connecting portion between the flywheel 221 and the crankshaft 223 is supported by the shaft hole 222*a* of the rotor 222 a so as to achieve a good stability.

Numeral 225 is a key to connect the cylindrical attachment portion 221*a* of the fly wheel 221 and the lower end portion of the crankshaft 223. As described hereinbefore, the flywheel 221 can be easily inserted into the shaft hole 222*a* of the rotor 222 by adjusting respective key grooves (not shown) provided on the cylindrical attachment portion 221*a* and the crankshaft 223. The key 225 has a function to reinforce the connection of the flywheel 221 and the crankshaft 223 and to prevent them from loosening. Thereby the good stability at the time of starting and stopping the compressor can be achieved.

In accordance with the present invention, the cylindrical attachment portion of the flywheel is formed on the base of the inner diameter of the rotor shaft hole in the reciprocating compressor and further the cylindrical attachment portion is inserted into the rotor shaft hole so as to adjust axial lines of the flywheel and the crankshaft, the flywheel can be threaded and fastened by one fastening bolt, thereby an easy attachment of the fly wheel can be achieved and excellent effects such that the axial adjustment with the crankshaft is easy with preventing the shaft from moving slightly and the like.

Embodiment 4

Figure 7:
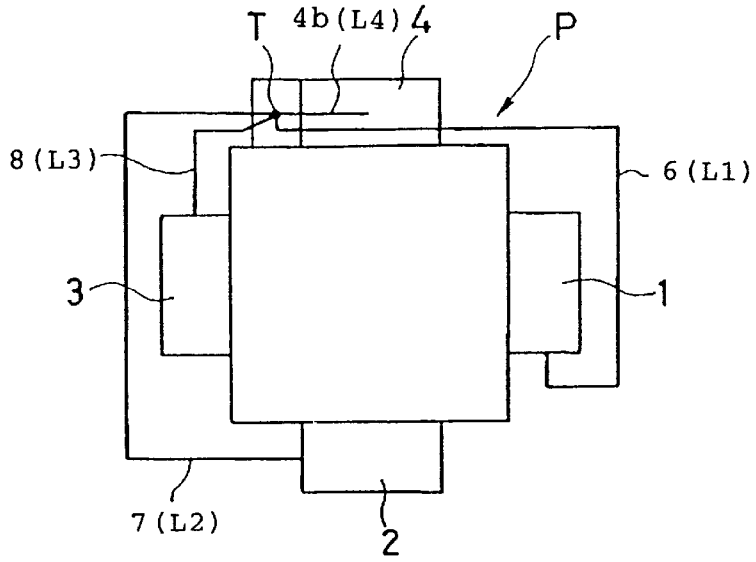
FIG. 7 is an explanation view imitating a reciprocating compressor according to the present invention.

The embodiment refers to achieve the fourth object of the present invention, in FIG. 7, the reciprocating compressor P1 is shown as a model so that the length of the first connecting tube 6 is shown by L1, the length of the second connecting tube 7 is shown by L2 and the one of the third connecting tube 8 is shown by L3, further the direction (as referred the fourth connecting tube 4*b*) from the fourth gas compression means 4 to the cylinder head 5 is shown by L4. Each inner diameter of connecting tubes is designed in same size.

As described hereinbefore during one rotation of the crank pin, gas is compressed by the first gas compression means 1 to the fourth gas compression means 4 in turns and the flow of compressed gas is joined to the cylinder head 5 to be discharged in concentration. The pulsation of compressed gas can be restrained if pressure waves are competed with each other at the joining point T. Since first gas compression means to the fourth gas compression means are shifted respectively in their phase to an angle of 90 degrees ($\pi/2$), it is necessary for the pressure wave of each compressed gas arrived to oppose with each other for one rotation ($2\pi$) of the crank pin.

The length of each connecting tube in the reciprocating compressor P1 is limited to a certain range due to a whole size of the compressor, for embodiment the preferable length L2 of the second connecting tube 2 is set to 1.133 m within the range thereof. The wave form of compressed gas passing through the second connecting tube 2 is measured by a pressure sensor attached thereto, there are appeared five crests of wave forms during one rotation of the crank pin and the rotating speed of the crank pin is 1800 rpm. The length L2 of the second connecting tube 2 is 1.133 m, further each preferable length of other connecting tubes within a range limited due to the whole size of the compressor is tested, then it is found that the pulsation is hold minimum by L1=0.708 m, L3=0.436 m, L4=0.298 m. After checking pressure wave forms of compressed gas passing through the first connecting tube 1, the third connecting tube 3 and the fourth connecting tube 4, during one rotation of the crank pin, there are 8 crests of wave form for the first connecting tube 1, 13 crests of wave form for the third connecting tube 3 and 19 crests of wave form for the fourth connecting tube 4*b*.

Figure 8:
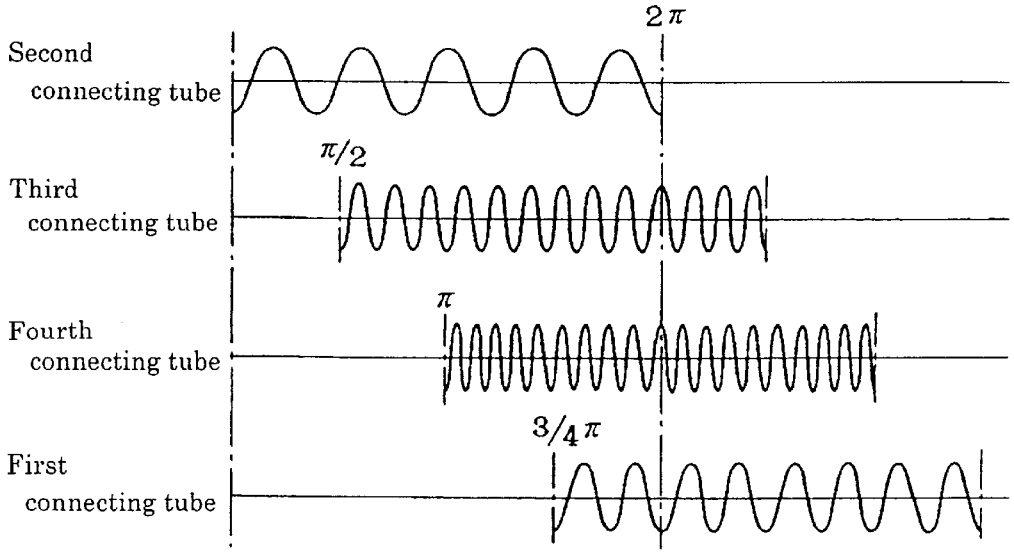
FIG. 8 is an explanation view illustrating a condition of a gas compression wave fed via a connecting tube from each gas compressor.
Figure 9:
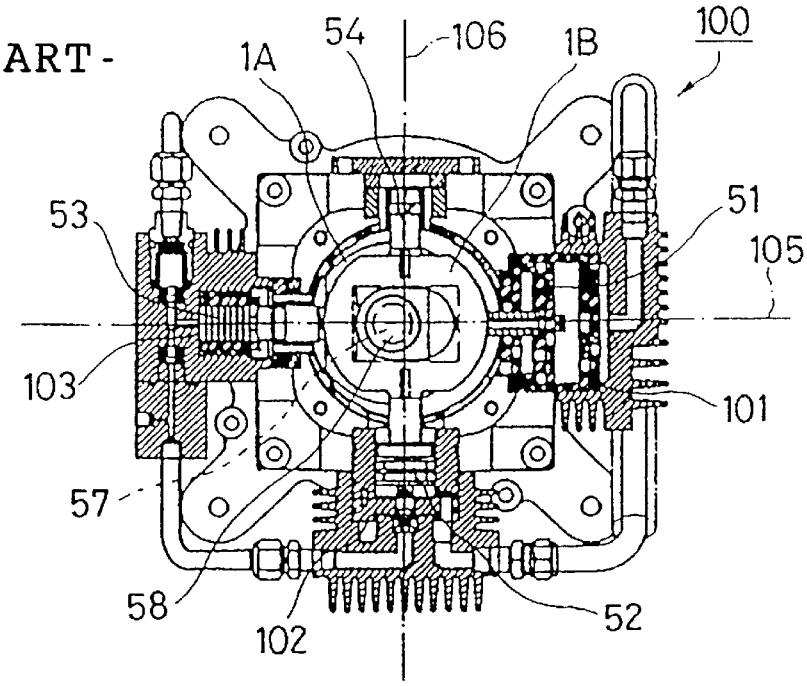
FIG. 9*a* illustrates a horizontal cut-away view of a conventional reciprocating compressor.
FIG. 9*b* is a vertical front view of a conventional reciprocating compressor.
Figure 9:
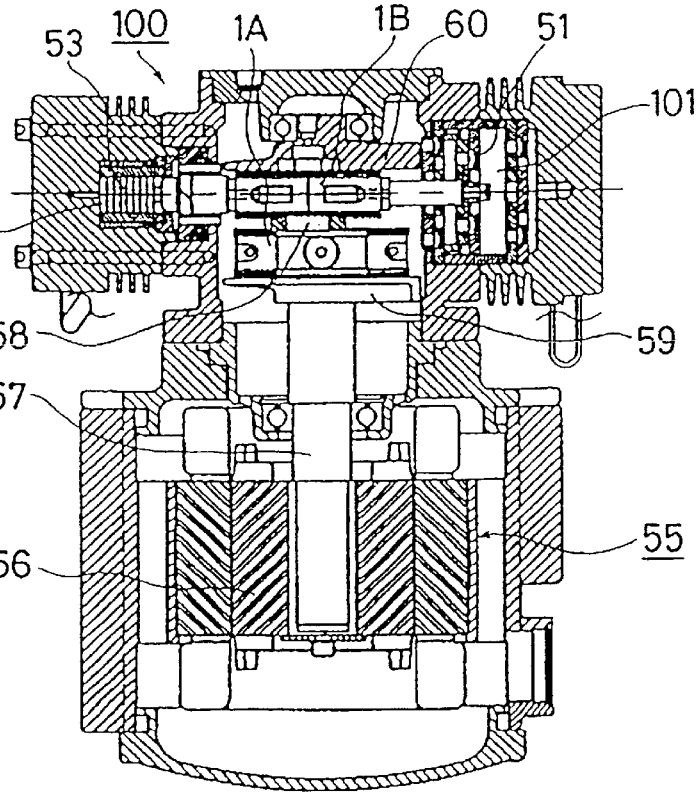
Figure 10:
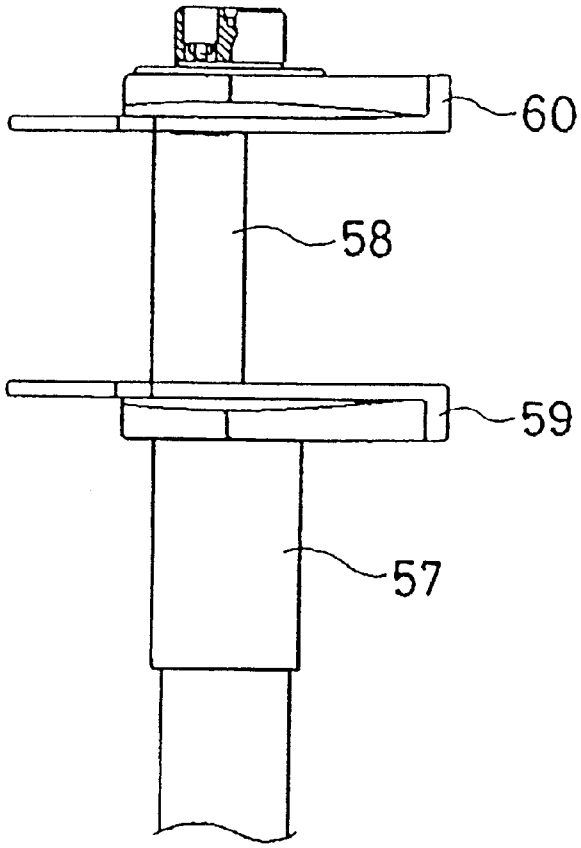
FIG. 10 is an explanation view of a crankshaft portion.
Figure 11:
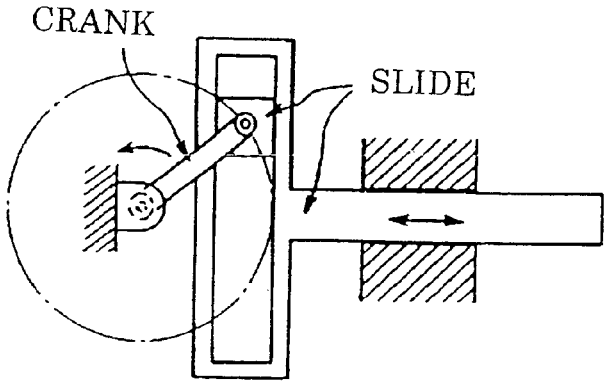
FIG. 11 is an explanation view of a scotch yoke mechanism.

In accordance with these wave tops, each pressure wave of which phase is shifted to an angle of 90 degrees is shown by FIG. 8, at the time of one rotation ($2\pi$) of the crank pin, it is shown that each pressure wave of the first gas compression means 1 and the opposite third gas compression means 3 is opposed to each other and each pressure wave of the second gas compression means 2 and the opposite fourth gas compression means 4 is opposed to each other. These cycles are repeated so that gas is discharged in concentration from the joining point T to the cylinder head 5 and the pulsation can be restrained at that time.

In accordance with the present invention, in the reciprocating compressor having a plurality of gas compression means, the length of each connecting tube for discharging compressed gas from each gas compression means to the joining point of the cylinder head is set to a predetermined length, thereby the pulsation of gas discharged in concentration can be hold minimum. Thereby the vibration or the noise of the reciprocating compressor can be excellently decreased. Further it is not necessary to attach the muffler to each connecting tube as a conventional type, thereby it can be prevented from a troublesome attachment work, an increase of the cost due to large number of parts or a large size of a main body of the compressor.

What is claimed is:

1. A reciprocating compressor provided with a plurality of gas compression means having a cylinder and a piston, wherein each of the gas compression means is oppositely disposed with respect to another of the gas compression means, in which the pistons of each gas compression means are cooperated with the compressor by converting a rotating motion of a crankshaft provided on an electric drive source to a reciprocating motion by a scotch yoke mechanism, characterized in that a sucked gas is compressed by each gas compression means, and the flows of compressed gases from each gas compression means are joined to one place so as to be discharged in concentration, wherein gases compressed by all but one of the gas compression means are respectively discharged into a cylinder head of like other remaining one of said the compression means by a connecting tube so as to be joined with gas compressed by the other remaining one of the gas compression means and discharged in concentration from a discharge port of the cylinder head of the other remaining one of the gas compression means.

2. A reciprocating compressor according to claim 1, wherein four of the gas compression means are oppositely disposed in a cross shape.

3. A reciprocating compressor according to claim 1, wherein two of the gas compression means are oppositely disposed, gas compressed by one of said gas compression means is discharged into a cylinder head of the other gas compression means by a connecting tube to join with gas compressed by said other gas compression means, and is discharged in concentration from the cylinder head thereof.

4. A reciprocating compressor comprising four gas compression means which are arranged oppositely with each other in a cross shape, two stage compression mechanisms with two systems composed of the first stage gas compression means and the second stage compression means by these four gas compression means are formed, wherein the first stage gas compression means and the second stage gas compression means in each system are respectively connected by a connecting tube, gas compressed by the first stage gas compression means is discharged into the second stage gas compression means, and the flows of further gases, compressed by the second stage gas compression means in each system are joined at one place to be discharged in concentration, wherein gases compressed by all but one of the gas compression means in each system are discharged into a cylinder head of the other remaining one of said the compression means in the system by the respective connecting tube of the system so as to be joined with gas compressed by the other remaining one of the gas compression means in the system and discharged in concentration from a discharge port of the cylinder head of the other remaining one of the gas compression means in the system.

* * * * *

UNITED STATES PATENT AND TRADEMARK OFFICE

CERTIFICATE OF CORRECTION

PATENT NO. : 6,589,024 B2
DATED : July 8, 2003
INVENTOR(S) : Takahiro Nishikawa et al.

It is certified that error appears in the above-identified patent and that said Letters Patent is hereby corrected as shown below:

Title page,
Item [57], ABSTRACT,
Line 10, “expression” should read -- expansion --;

Column 2,
Line 9, “cast” should read -- cost --; and

Column 9,
Line 35, “of like” should read -- of the --.

Signed and Sealed this

Twenty-ninth Day of June, 2004

JON W. DUDAS
*Acting Director of the United States Patent and Trademark Office*